United States Patent [19]

Hicks et al.

[11] Patent Number: 4,747,856

[45] Date of Patent: May 31, 1988

[54] LOWER END ALIGNMENT DEVICE FOR ELECTROSTATIC PRECIPITATOR COLLECTOR ELECTRODES

[75] Inventors: Ricky D. Hicks; Anthony J. DiBlasi, both of Lebanon, Pa.

[73] Assignee: General Electric Environmental Services, Inc., Lebanon, Pa.

[21] Appl. No.: 87,840

[22] Filed: Aug. 21, 1987

[51] Int. Cl.[4] ..... B03C 3/45

[52] U.S. Cl. ..... 55/143; 55/148; 55/156

[58] Field of Search ..... 55/141, 143, 145, 148, 55/140, 156

[56] References Cited

U.S. PATENT DOCUMENTS

| | | | |
|---|---|---|---|
| 1,584,055 | 5/1926 | Weiskopf | 55/145 X |
| 2,704,135 | 3/1955 | Marriott et al. | 55/148 |
| 2,812,035 | 11/1957 | Sohlman et al. | 55/148 X |
| 3,113,852 | 12/1963 | Steuernagel | 55/148 X |
| 3,435,594 | 4/1969 | Steuernagel | 55/140 X |
| 3,530,645 | 9/1970 | De Lisio | 55/156 X |
| 3,844,742 | 10/1974 | Petersen | 55/148 X |
| 4,240,810 | 12/1980 | Frauenfelder | 55/143 |
| 4,502,872 | 3/1985 | Ivester et al. | 55/148 X |
| 4,516,992 | 5/1985 | Jonelis | 55/145 |
| 4,666,474 | 5/1987 | Cook | 55/137 |

*Primary Examiner*—Kathleen J. Prunner

*Attorney, Agent, or Firm*—Ernest F. Chapman; Robert A. Cahill

[57] ABSTRACT

To maintain alignment of the lower ends of the multiple electrode panels of an electrostatic precipitator collector electrode, an alignment device is utilized having an elongated bar mounted adjacent its ends in aligned underlying relation with the bottom edges of the electrode panels which are suspended in lateral edge-to-edge, essential coplanar relation. The bar, in turn, mounts a distributed plurality of pairs of opposed wicket-shaped aligning elements in flanking relation with the lower end portion of each panel to resist lateral, swaying movement, while permitting the limited panel motion occurring during normal precipitator operation.

7 Claims, 3 Drawing Sheets

LOWER END ALIGNMENT DEVICE FOR ELECTROSTATIC PRECIPITATOR COLLECTOR ELECTRODES

The present invention relates to electrostatic precipitators and is specifically directed to apparatus for maintaining the alignment of the multiple panels of the collector electrodes in an electrostatic precipitator.

BACKGROUND OF THE INVENTION

Electrostatic precipitators are commonly used in a wide variety of industrial applications to remove particulate material from flue gases. Such precipitators typically include a plurality of elongated collector electrodes of a generally planar configuration which are suspended within a chamber through which flue gas is routed. Discharge electrodes, typically in the form of wires, are stationed in proximity to the collector electrodes, and a high DC voltage differential is applied across the discharge and collector electrodes. The resulting electrostatic field therebetween attracts particulate material or flyash from the flue gas to the electrode surfaces. Periodically the precipitator is put through a cleaning operation which typically involves mechanically vibrating the electrodes to shake the flyash loose from the electrode surfaces. The loosen flyash falls into a hopper in the bottom of the chamber from which it is collected for eventual disposal.

As is well understood in the art, the spacings between the discharge and collector electrodes must be maintained essentially constant if the precipitator is to achieve its performance ratings. For example, if the interelectrode spacing decreases, the magnitude of the electrode voltage differential must be decreased to avoid arcing. This reduces the electrostatic field intensity which, in turn, degrades the capability of precipitating out the flyash entrained in the flue gas.

Controlling the positions of the collector electrodes is particularly troublesome since they are quite large in physical size. For example, each collector electrode can be in excess of ten feet wide and twenty feet long in large precipitator designs. Because of this large size, each collector electrode typically consists of a plurality of elongated, narrow electrode panels separately suspended in lateral edge-to-edge, essentially coplanar relation to make up the full collector electrode width. The lower ends of these individual collector electrode panels must then be maintained in alignment during precipitator operation. Means to this end must however accommodate limited movements of the electrode panels caused by thermal expansion and contraction and during the cleaning operation when they are mechanically vibrated by means such as a rapping mechanism. Such alignment maintaining devices should also be designed to resist excessive flyash buildup which in time could constrain this limited electrode panel movement, causing them to bow and thus alter their spacings with the discharge electrodes. In the extreme, the electrode panels could become unhooked from their suspension mounting hangers. In addition, such alignment maintaining devices should be of sufficient strength to resist distortion should the underlying hopper backup to the point where it becomes immersed in flyash.

OBJECTS OF THE INVENTION

It is accordingly an object of the present invention to provide an improved device for maintaining the lower ends of the collector electrodes of an electrostatic precipitator in proper alignment.

An additional object is to provide an alignment device of the above-character which readily accommodates collector electrode movements normally occurring during precipitator operation.

A further object is to provide an alignment device of the above-character which is relatively immune to being fouled by flyash buildup.

Yet another object is to provide an alignment device of the above-character which is of enhanced strength.

A still further object is to provide an alignment device of the above-character which is capable of being retrofitted in the field in a simple and labor efficient manner.

Another object is to provide an alignment device of the above-character which is simple in construction, easy to install, and reliable in its purpose over a long service life.

Other objects of the invention will in part be obvious and in part appear hereinafter.

SUMMARY OF THE INVENTION

In accordance with the present invention there is provided a device for maintaining proper alignment of the multiple electrode panels of a collector electrode which are individually suspended from the frame of an electrostatic precipitator in lateral edge-to-edge, essentially coplanar relation. The alignment device includes an enlongated, structurally rigid, straight bar mounted adjacent its opposed ends by the precipitator frame in underlying relation to the bottom edges of the electrode panels. Plural pairs of laterally opposed channel or wicket-shaped elements of circular cross section are affixed to the bar at their free ends in upwardly extending relation thereto. The element pairs are distributed along the length of the bar such that the elements of each pair are disposed in flanking relation with the lower end portion of a different one of the electrode panels.

The separation between opposed elements of each element pair is slightly in excess of the electrode panel gauge such that the lower ends thereof can be readily inserted therebetween to facilitate factory assembly or field retrofitting. Since the lower end of each electrode panel is flanked by the opposed elements of an element pair, lateral, swaying movements thereof are precluded, and thus electrode panel alignment is maintained. Yet the electrode panels are not constrained against the limited, generally vertical movements thereof occurring during normal precipitator operation.

In an alternative embodiment of the invention, the bar is in the form of a pair of coextensive bar sections which respectively carry the corresponding elements of each element pair. In assembly, the bar sections are affixed together while the elements are positioned in respectively opposed, paired interrelation and in flanking relation with the lower end portions of the electrode panels.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following description taken in conjunction with the accompanying drawings, in which.

Corresponding reference numerals refer to like parts throughout the several views of the drawings.

DETAILED DESCRIPTION

Figure 1:
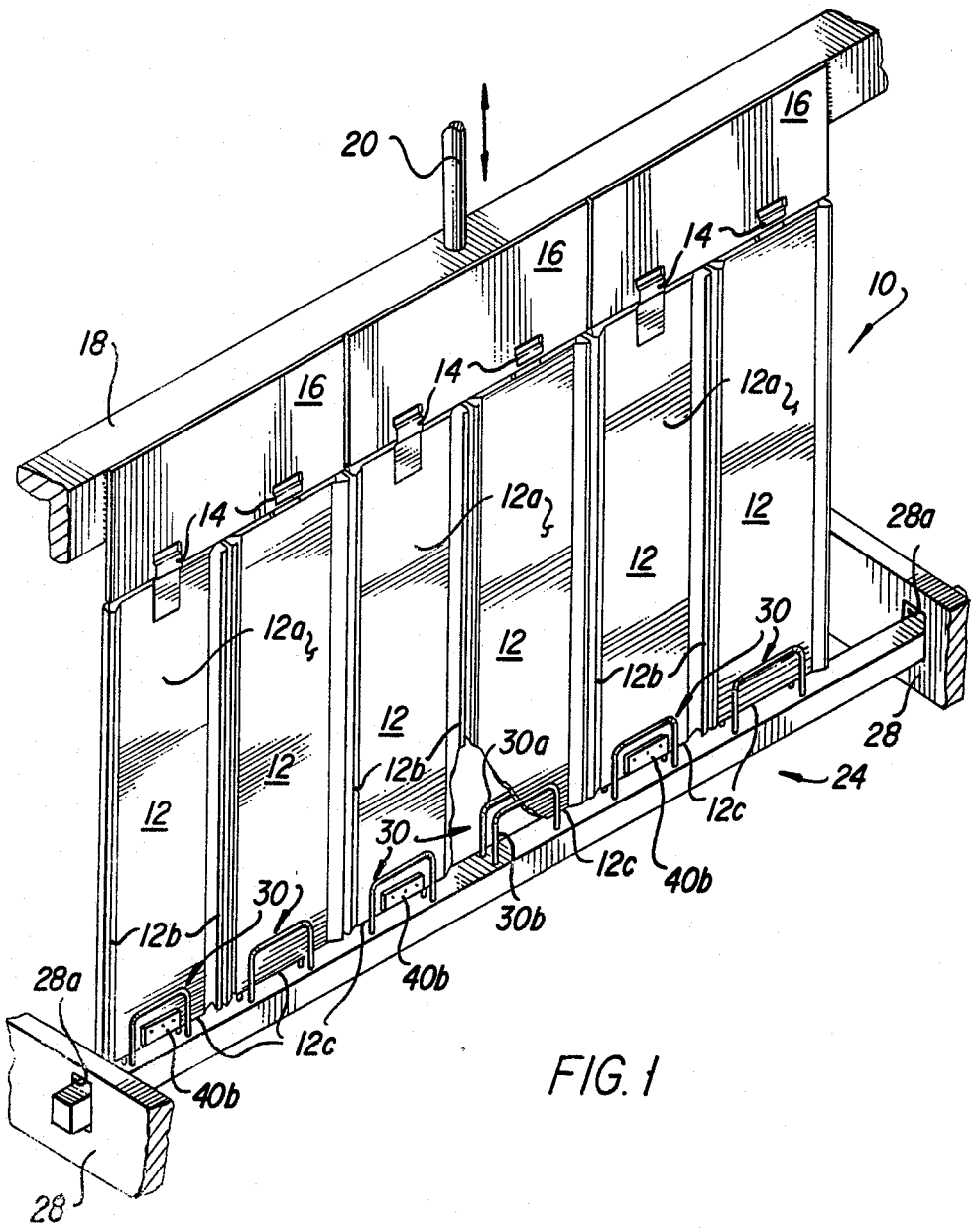
FIG. 1 is a perspective view of an alignment device constructed in accordance with one embodiment of the invention and shown in its installed position relative to the individual panels of an electrostatic precipitator collector electrode.

Referring first to FIG. 1, an electrostatic precipitator collector electrode, generally indicated at 10, is illustrated as consisting of a plurality of elongated, narrow electrode panels 12 which are individually suspended in lateral edge-to-edge, essentially coplanar relation by hooks 14 from hanger members 16 commonly affixed to a cross beam 18. This cross beam is connected, as indicated at 20, to a rapping mechanism (not shown) which operates during a cleaning operation to mechanically vibrate the electrode panels and thus dislodge flyash clinging to the surfaces thereof. Each electrode panel is formed having a planar midsection 12*a* of appropriate thickness, such as eighteen gauge, bounded by flange configured lateral edges 12*b* for stiffening purposes.

Figure 2:
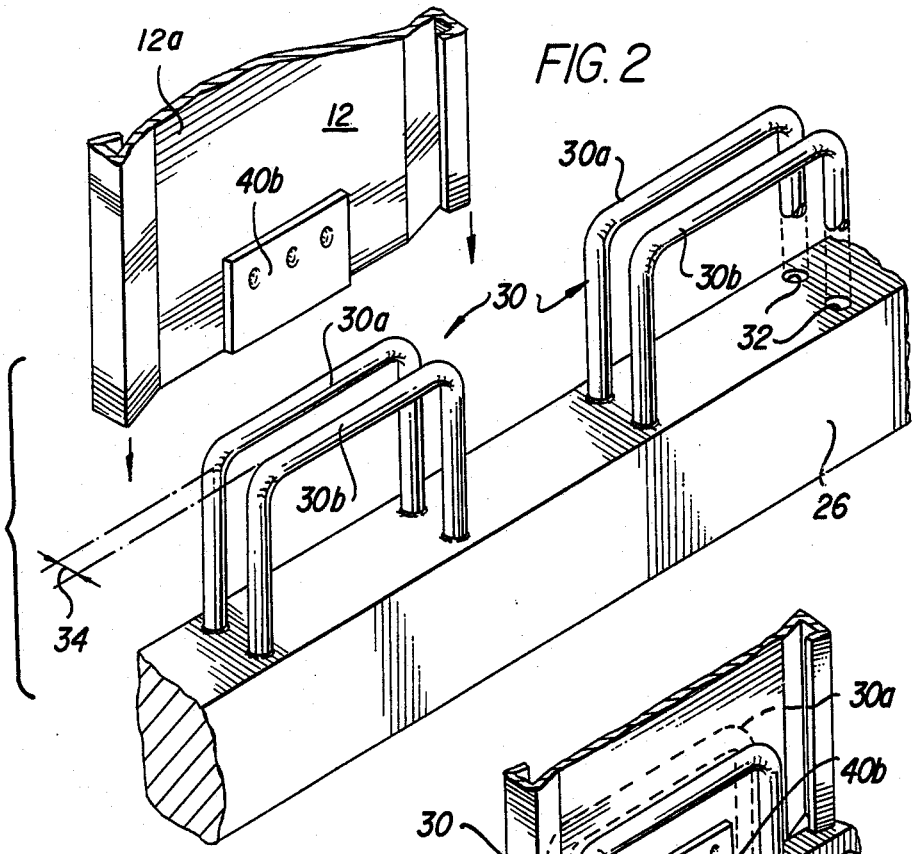
FIG. 2 is an enlarged, fragmentary perspective view of the alignment device of FIG. 1.

Referring jointly to FIGS. 1 and 2, the alignment device of the invention embodiment illustrated therein, generally indicated at 24, includes an elongated, structurally rigid, metal bar 26, preferably of rectangular cross section, which is supported adjacent its opposed ends in any convenient manner such as to be positioned in immediate underlying relation with the bottom edges 12*c* of the electrode panels. As illustrated in FIG. 1, such bar supporting means may be constructed in the manner of slots 28*a* in precipitator opposed side frame members 28 through which the bar ends are inserted and welded in place or left free therein for limited vertical movement.

As best seen in FIG. 2, bar 26 is equipped with a series of pairs 30 of laterally opposed aligning elements 30*a* and 30*b* which are each of inverted channel or wicket configuration. Preferably these wickets are formed of circular metal bar stock to facilitate alignment device installation and to avoid electrical charge concentrating sharp corners. To affix these wickets to bar 26, blind holes 32 of suitable depth are drilled in the flat upper surface of the bar at appropriate locations along its length to receive the free ends or legs of the wickets, which are then welded in place. The wickets 30*a*, 30*b* are thus supported in upstanding or upwardly extending relation to the bar in opposed pairs at spaced locations respectively vertically aligned with the planar midsections 12*a* of the individual electrode panels 12. The gap 34 between opposed wickets 30*a*, 30*b* of each pair is slightly in excess of the panel midsection thickness such that the lower end portion of these panel midsections are readily received therebetween. The length of these wickets is of course less than the width of the panel midsection so as to avoid interference with the configured lateral edges 12*b* of the panels.

By virtue of the above-described construction, it is seen that the opposed wickets 30*a*, 30*b* of the element pairs 30 are in respective flanking relation with the lower end portion of the planar midsections of the electrode panels to preclude lateral, swaying movements thereof. Consequently, requisite alignment of the panel lower ends is maintained while accommodating the limited panel movements occasioned by normal precipitator operation. Since the panel lower ends are simply inserted between opposed wickets, installation is easy even in the field. By virtue of the inverted channel configuraton and circular cross section of the wickets, flyash buildup is minimized, and fouling to the extent of constraining normal panel movement is avoided. Moreover, bar 26 is of sufficient strength to resist distortion under hopper overfill conditions.

Figure 3:
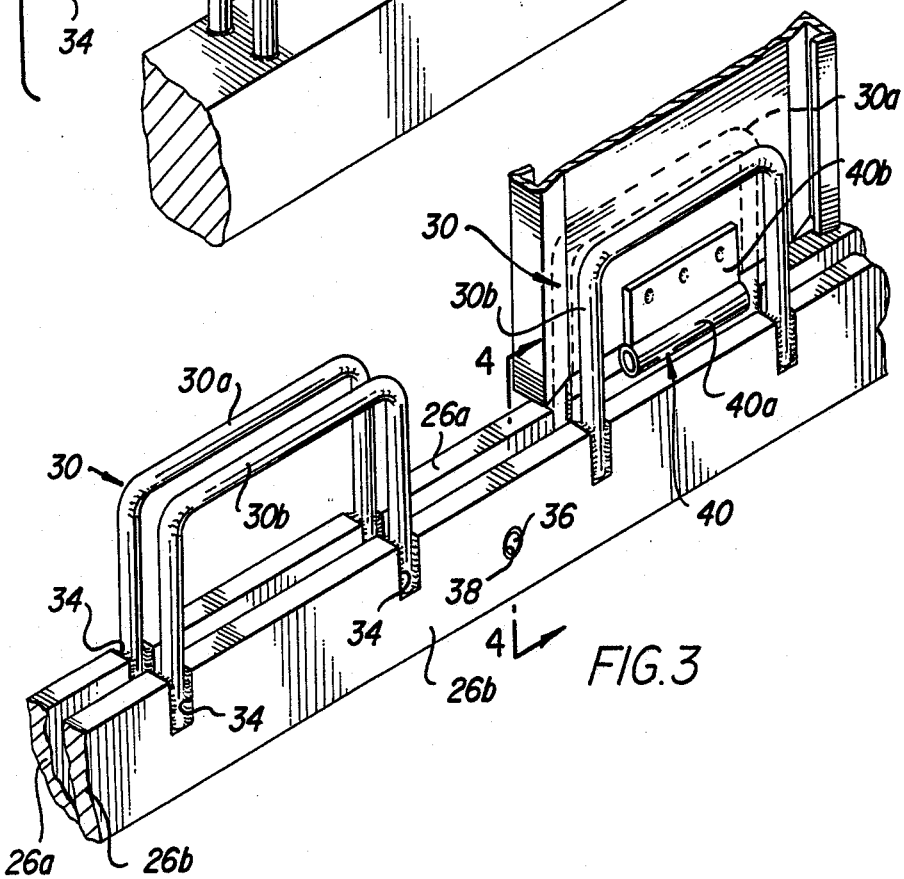
FIG. 3 is a fragmentary perspective view of an alignment device constructed in accordance with an alternative embodiment of the invention.
Figure 4:
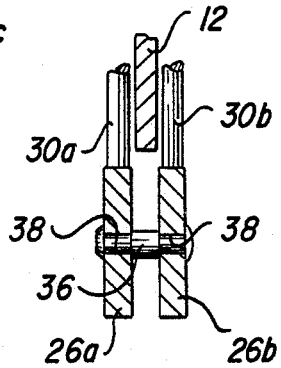
FIG. 4 is a sectional view taken along line 4—4 of FIG. 3.

The foregoing benefits of the invention are also achieved in the embodiment illustrated in FIGS. 3 and 4, wherein the wicket mounting bar is in the form of a pair of coextensive bar sections 26*a* and 26*b*. Bar section 26*a* mounts wickets 30*a* of each pair 30, while bar section 26*b* mounts wickets 30*b* of each pair. Wicket mounting may be achieved by notching the upper edges of the bar sections, as indicated at 34, at appropriate locations along their lengths for receipt of the free ends of the wicket legs. The wickets are welded in place for upward extension from the bar sections in the fashion of the FIGS. 1 and 2 embodiment. The bar sections are positioned side-by-side in underlying relation with the electrode panel lower edges and with their wickets 30*a* and 30*b* in opposed, paired relation flanking the panel midsections 12*a*. Using locating pins 36 whose ends are received in a correspondingly distributed series of locating holes 38 in each bar section and welded in place, the bar sections are united to provide a unitary, structurally rigid wicket mounting member in the manner of bar 26 in FIG. 1. The pins 36 may be shouldered, as illustrated in FIG. 4, to establish the requisite gap between the pins of opposed wickets 30*a*, 30*b*. The unitized coextensive bar sections may, in turn, be mounted in the manner illustrated in FIG. 1.

Figure 5:
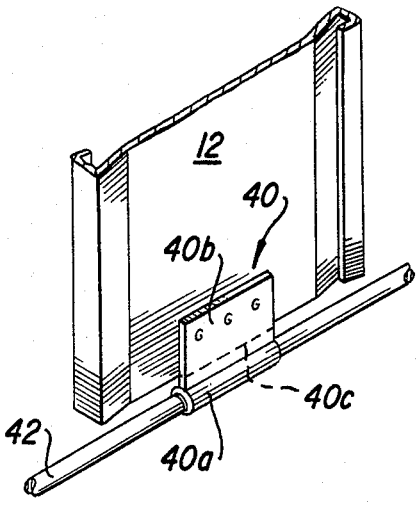
FIG. 5 (PRIOR ART)
FIG. 5 is a fragmentary perspective view of one type of prior art alignment device for which the alignment device of the present invention is retrofittable in the field.

As noted above, an important feature of the disclosed embodiments of the invention is their facile field retrofitability. FIG. 5 illustrates one type of prior art electrode panel lower end alignment device wherein each panel 12 is equipped with an aligning element 40 in the form of a tube or sleeve 40*a* depending from a planar pad 40*b* welded to the lower end portion of the panel planar midsection. The tube axis is aligned with and lies immediately below the lower edge of the panel midsection. A rod 42 is threaded through the tubes 40*a* depending from the various panels of a collector electrode and mounted adjacent its ends by opposed side frame members to maintain panel lower end alignment. To accommodate the limited panel movement occurring during normal precipitator operation, the diameter of rod 42 is smaller than the inner diameter of the tubes 40*a*. Unfortunately flyash builds up between the rod and the tubes, thus constraining this limited normal panel movement. Moreover, rod 42, being a rather slender member, is not of sufficient strength to resist distortion under hopper overfill conditions.

An important feature of the present invention is the ease in which the disclosed embodiments thereof can be field retrofitted in lieu of the type of electrode panel lower end alignment device illustrated in FIG. 5. To this end, the tubes 40*a* are cut off generally along dash line 40*c* by a torch, leaving pads 40*b* affixed to the lower end portions of the panel midsections, as is illustrated in FIGS. 1 and 2. The gap between opposed wickets 30*a*, 30*b* of the wicket pairs 30 can be made sufficient to readily accept the combined thickness of both the panel midsection and the pad 40*b* for facile installation. Alternatively, this gap dimension may be made slightly less than this combined panel and pad thickness, in which case the upper portions of the wickets would be spread apart during installation. It is seen that, upon installation, pads 40*b* are accommodated within the bounds of the wickets with ample clearance to avoid constraining normal panel movement.

The embodiment of the invention seen in FIGS. 3 and 4 has the additional advantage in that the tubes 40*a* need not be severed from their pads 40*b* incident to the retrofit procedure. Since the bar sections 26*a* and 26*b* can be united after their wickets have been positioned in opposed relation flanking the panel midsections, insertion of the panel lower ends between opposed wickets in fixed gap relation is not involved. From FIG. 3, it is seen that the intact alignment elements 40 are accommodated within the bounds of the wickets with ample clearance for unconstrained normal panel movement.

Figure 6:
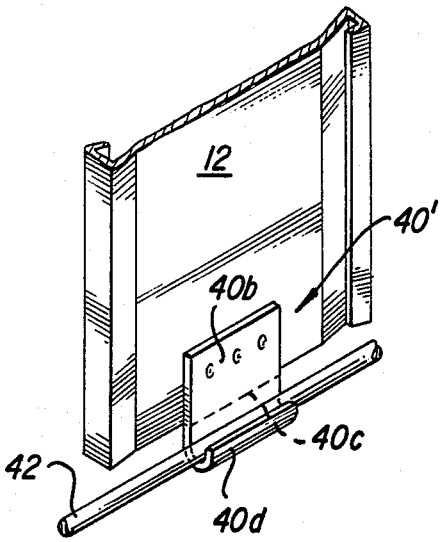
FIG. 6 (PRIOR ART)
FIG. 6 is a fragmentary perspective view of another type of prior art alignment device for which the alignment device of the present invention is also field retrofittable.

FIG. 6 illustrates another type of panel lower end alignment device which employs aligning elements 40' in the form of a hook 40*d* depending from a mounting pad 40*b* welded to the lower end portion of a panel midsection. Slender bar 42 is threaded through these hooks and mounted at its ends to maintain alignment of the panel lower ends. The hooks are semicircular in cross section with the openings thereinto of a width less than the rod diameter. The rods are thus loosely captivated by the hooks with sufficient clearance to accommodate normal panel movement. It is apparent that the aligning element hooks 40*d* are more susceptible to being fouled by flyash buildup than the tubes 40*a* of FIG. 5. To retrofit electrostatic precipitators equipped with alignment elements 40', hooks 40*d* are severed therefrom generally along dash line 40*c*, leaving pads 40*b*. Field installation of either of the embodiments of the invention is then as described above.

It will be appreciated that the welding of the wickets to the bars or bar sections can be performed in the shop, thus minimizing the number of time consuming welding operations requisite to retrofitting the collector electrode panel lower end alignment device embodiments of the invention to electrostatic precipitators out in the field.

It will thus be seen that the objects set forth above, including those made apparent from the preceding description, are efficiently attained, and, since certain changes may be made in the disclosed embodiments without departing from the scope of the invention, it is intended that all matter contained in the above description and shown in the accompanying drawings shall be interpreted as illustrative and not in a limiting sense.

Having described the invention, what is claimed as new and desired to secure by Letter Patent is:

1. In an electrostatic precipitator having at least one collector electrode in the form of a plurality of electrode panels vertically suspended at their upper ends in closely spaced, essentially coplanar relation, a device for maintaining the lower ends of the electrode panels in aligned relation comprising, in combination:

A. an elongated bar mounted by a precipitator frame in a position underlying the lower ends of the electrode panels; and B. plural pairs of laterally opposed first and second channel-shaped elements each having free ends affixed to said bar so as to extend upwardly therefrom in wicket-like fashion, said element pairs being distributed along the length of said bar with said first and second elements of each said pair respectively disposed in flanking relation with the lower end portion of each of the electrode panels.

2. The device defined in claim 1, wherein said bar is in the form of first and second bar sections affixed together in parallel, substantially coextensive relation, said free ends of said first elements of each said pair being affixed to said first bar section and said free ends of said second elements of each said pair being affixed to said second bar section.

3. The device defined in claim 2, wherein said first and second elements are both of circular cross section.

4. The device defined in claim 2, wherein said first and second bar sections are formed with transverse locating holes at corresponding locations along the lengths thereof, said device further including a separate locating pin having opposed ends affixed in said locating holes at each of said corresponding locations in said first and second bar sections, whereby to affix said first and second bar sections together in closely spaced parallel relation.

5. The device defined in claim 4, wherein said first and second element free ends are welded to said first and second bar sections, respectively.

6. The device defined in claim 1, wherein said first and second elements are both of circular cross section.

7. The device defined in claim 1, wherein said first and second element free ends are welded to said bar.

* * * * *